US007264286B2

(12) United States Patent
Thompson

(10) Patent No.: US 7,264,286 B2
(45) Date of Patent: Sep. 4, 2007

(54) RECESSED LIFT GATE LATCH

(76) Inventor: David M. Thompson, 802 Mantoloking Rd., Bricktown, NJ (US) 08723

( * ) Notice: Subject to any disclaimer, the term of this patent is extended or adjusted under 35 U.S.C. 154(b) by 4 days.

(21) Appl. No.: 11/273,446

(22) Filed: Nov. 14, 2005

(65) Prior Publication Data

US 2007/0120379 A1 May 31, 2007

(51) Int. Cl.
*E05C 17/02* (2006.01)
*E05B 15/02* (2006.01)

(52) U.S. Cl. ..... 292/300; 292/340; 292/DIG. 15; 292/DIG. 19; 114/364; 16/82

(58) Field of Classification Search ..... 292/1, 292/300, 340, 341, 341.14, 341.18, DIG. 15, 292/DIG. 19; 16/82; 49/57, 234, 255, 258, 49/472; 114/364; 256/26, 73
See application file for complete search history.

(56) References Cited

U.S. PATENT DOCUMENTS 412,986 A * 10/1889 Schoen et al. ..... 292/180
1,005,906 A * 10/1911 Varner ..... 292/341.14
1,723,007 A * 8/1929 Bittorf ..... 292/57
2,703,728 A * 3/1955 Raber ..... 292/288
4,263,749 A * 4/1981 McDougle ..... 49/394
4,366,975 A * 1/1983 Cotard ..... 292/340
4,790,589 A * 12/1988 Moore et al. ..... 296/50
5,018,241 A * 5/1991 Baines ..... 16/82
5,398,982 A * 3/1995 Watson, Jr. ..... 292/259 R
5,531,490 A * 7/1996 Parker ..... 292/262
6,443,088 B1 * 9/2002 Putman et al. ..... 114/343
6,666,486 B1 * 12/2003 Fleming ..... 292/145
6,739,093 B1 * 5/2004 Holbert ..... 49/394
6,945,575 B2 * 9/2005 Thompson ..... 292/340

FOREIGN PATENT DOCUMENTS

GB 2030639 * 4/1980

* cited by examiner

*Primary Examiner*—Carlos Lugo
(74) *Attorney, Agent, or Firm*—Andrew W. Ludy

(57) ABSTRACT

A lift gate latch is used with a lift gate and a handrail on a boat having a deck. The handrail has a jamb with a hollow interior having a predetermined width and breadth. The lift gate has a stile and a sliding hinge. The lift gate latch comprises a cup inserted in the deck, to receive the stile. A flange extends outward from the cup upper end, to mount against the boat deck. A tongue extends outward from the flange. A block extends upward from the tongue. The block is slidingly received in the jamb. The block has a breadth less than the jamb interior breadth, to allow adjustment of the clearance between the jamb and the stile. The flange and the tongue each present a low profile on the deck.

8 Claims, 4 Drawing Sheets

RECESSED LIFT GATE LATCH

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of gates, and more particularly to a lift gate closure latch for a patio boat.

Patio and pontoon boats have greatly increased in number and popularity in recent years. These boats are typically equipped with aluminum handrails along the port and starboard sides, and across the bow and stem. The handrails are usually fastened to the boat deck adjacent the gunwale. The handrails include gates by which to embark and disembark, one on each side and often one forward. These are typically lift gates. A lift gate slides vertically on the same hinges on which it is pivotally mounted. The sliding movement allows a latch to engage as the gate is lowered, in order to secure the gate against opening. Lifting the gate will disengage the latch so that the gate will swing open.

One type of gate latch comprises a hook, or U-shaped element engaging a loop or eye element. The components must first be fabricated. One element is welded or bolted to the gate, and the other to the jamb. This process is labor intensive. The latch rattles when the boat is underway, and it is not very attractive.

Another type of gate latch comprises a generally U-shaped bracket mounted on the boat gunwale. The gate stile fits into the bracket as the gate is lowered. This latch is typically molded of plastic. It has a base portion with the mounting screws, and upright walls, which are prone to breakage. This latch presents a trip hazard to crew and guests.

Accordingly, there is a need to provide a lift gate latch that can be installed quickly and easily with a minimum of skill.

There is a further need to provide a lift gate latch of the type described and that will not present a trip hazard to personnel.

There is a yet further need to provide a lift gate latch of the type described and that will not rattle when the boat is underway.

There is a still further need to provide a lift gate latch of the type described and that will not rust or corrode, and yet is strong and very attractive.

There is another need to provide a lift gate latch of the type described and that can be manufactured cost-effectively in large quantities of high quality.

BRIEF SUMMARY OF THE INVENTION

In accordance with the present invention, there is provided a lift gate latch for use in connection with a lift gate and a handrail on a boat. The boat has a gunwale and a deck with a receiving hole adjacent the gunwale. The handrail has a jamb with a hollow interior. The jamb interior has a predetermined width transverse to the boat, and a predetermined breadth longitudinal to the boat. The lift gate has a stile and a hinge, and is able to rise upwardly on the hinge. The lift gate is able to pivot on the hinge between a closed and an open position. The lift gate latch comprises a cup having a wall extending between opposite upper and lower ends. The cup has a hollow interior. The cup upper end is open, and a floor encloses the lower end. The cup is adapted for insertion in the receiving hole. The cup interior is adapted for receiving the stile.

A flange encircles the cup upper end and extends outward therefrom. The flange has an upper surface and a lower surface. The flange lower surface is adapted for mounting against the boat deck. A tongue extends outward from the flange. The tongue has an upper surface and a lower surface. The tongue lower surface is aligned with the flange lower surface for placement against the boat deck.

A block extends upward from the tongue upper surface. The block is adapted to be slidingly received in the jamb interior. The block has a width commensurate with the jamb interior width, and a breadth substantially less than the jamb interior breadth. This is to allow adjustment of the jamb during installation, thereby adjusting clearance between the jamb and the stile.

Thus, upon opening the lift gate, the lift gate will rise, the stile will pass above the upper end, and the gate will be pivoted open. Upon closing the lift gate, the gate will be pivoted closed, and the stile will pass above the upper end. The lift gate will then be lowered such that the stile will be received in the cup, thereby latching the gate.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
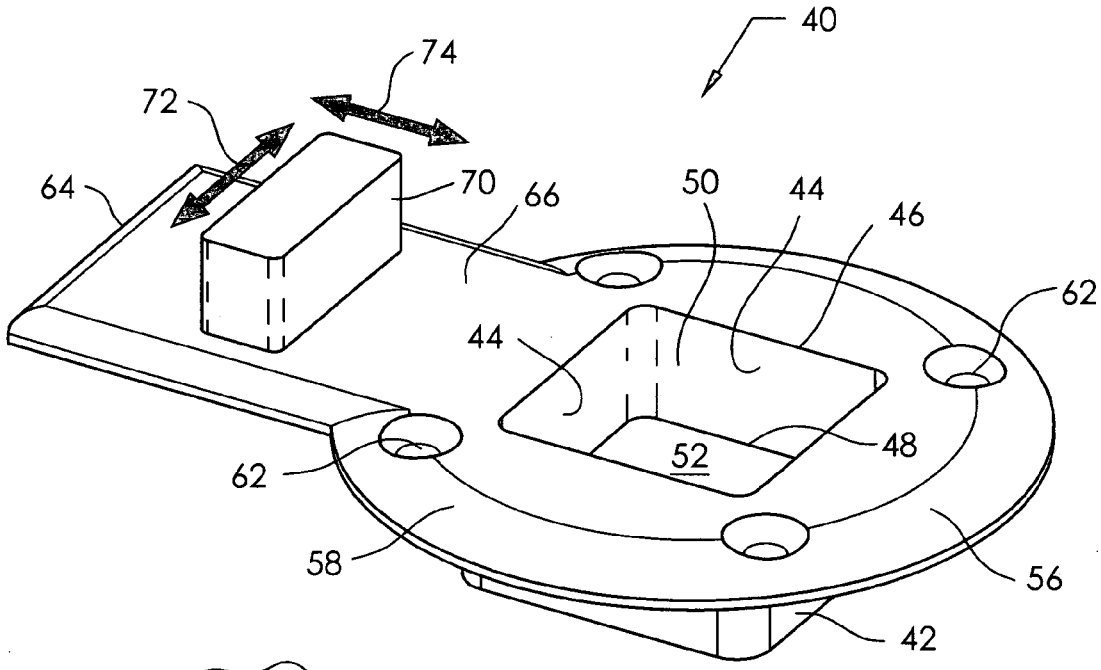
FIG. 1 is a perspective view of a lift gate latch constructed in accordance with the invention.
Figure 2:
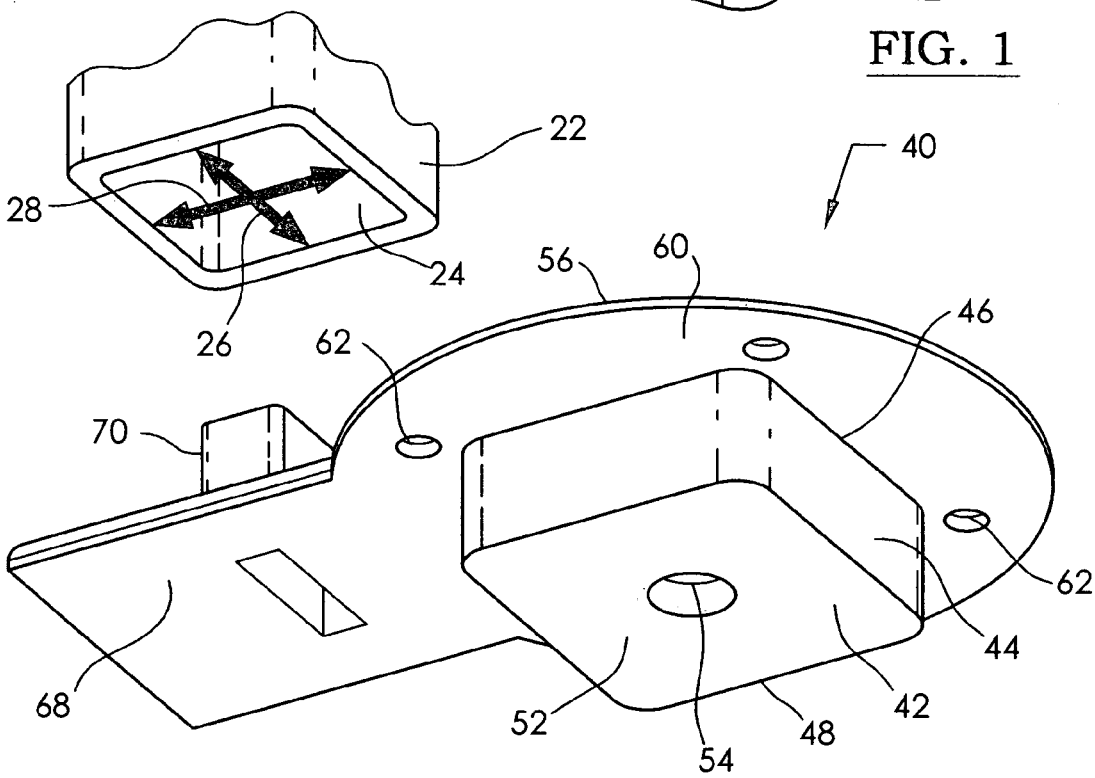
FIG. 2 is another perspective view of the lift gate latch of FIG. 1.
Figure 3:
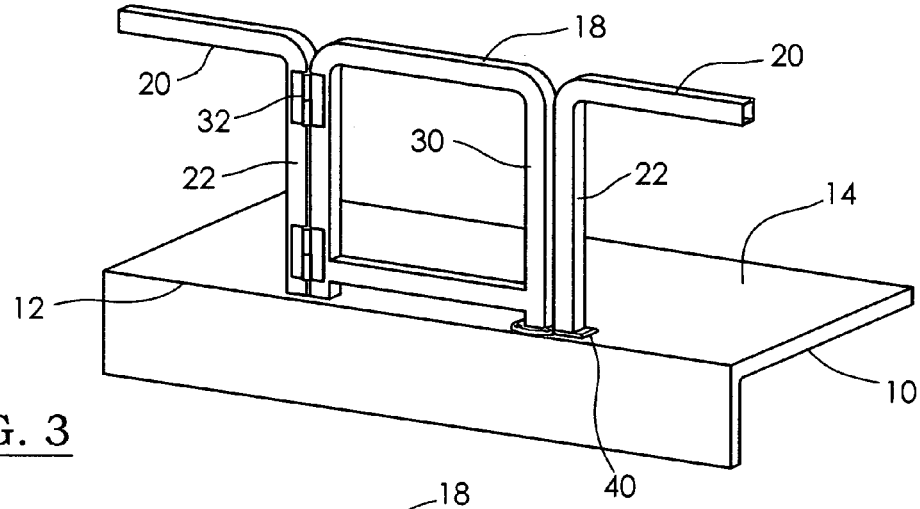
FIG. 3 is a perspective view of a pontoon boat deck and side, showing a handrail, a lift gate in the latched position, and the lift gate latch of FIG. 1.
Figure 4:
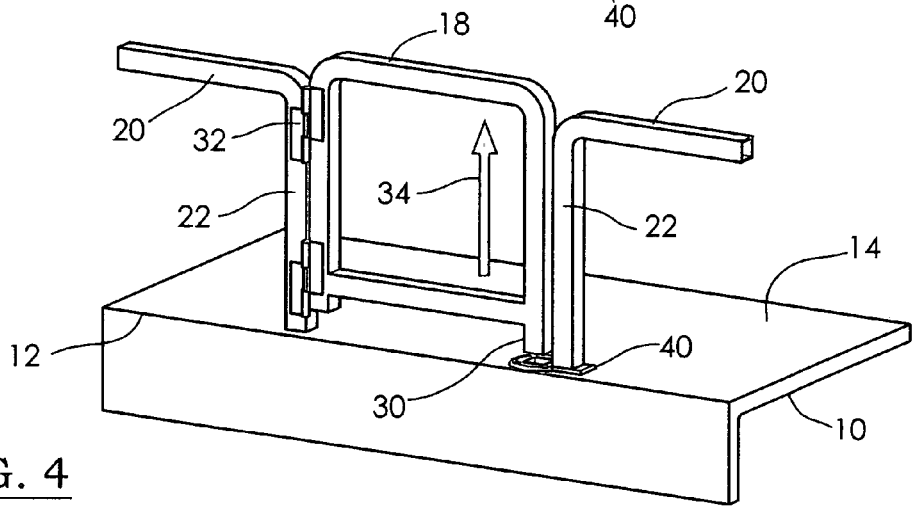
FIG. 4 is a perspective view of the pontoon boat of FIG. 3, showing the lift gate in the raised and unlatched position.
Figure 5:
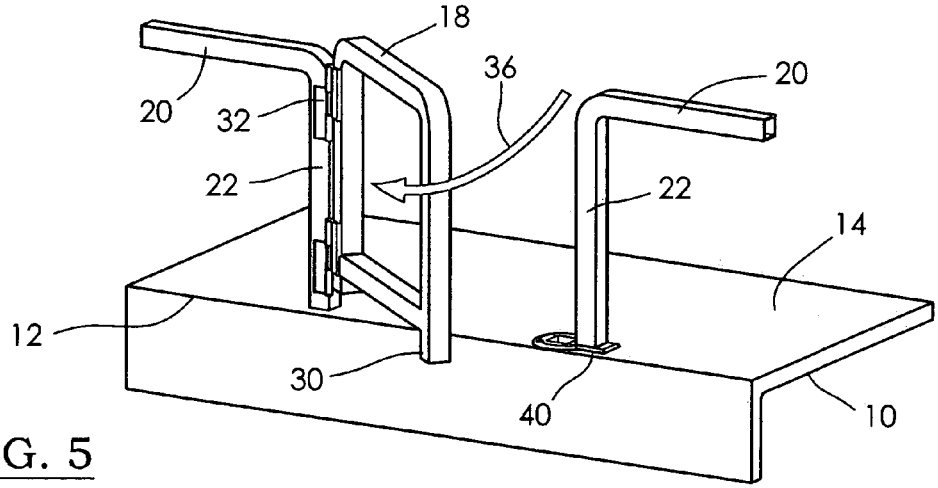
FIG. 5 is a perspective view of the pontoon boat of FIG. 3, showing the lift gate pivoted open.

Referring now to the drawing, and especially to FIGS. 3, 4, and 5 thereof, a lift gate latch is shown at 40, and is for use in connection with a lift gate 18 and a handrail 20 on a boat 10. The boat 10 has a gunwale 12 and a deck 14 with a receiving hole 16 adjacent the gunwale 12. The handrail 20 has a jamb 22 with a jamb interior 24 has a predetermined width 26 transverse to the boat, and a predetermined breadth 28 longitudinal to the boat. The lift gate 18 has a stile 30 and a hinge 32, and is able to rise upwardly on the hinge 32, as shown by arrow 34 in FIG. 4. The stile 30 and jamb 22 are rectangular in cross-section. The lift gate 18 is able to pivot on the hinge 32 between a closed and an open position, as shown by arrow 36 in FIG. 5.

Figure 6:
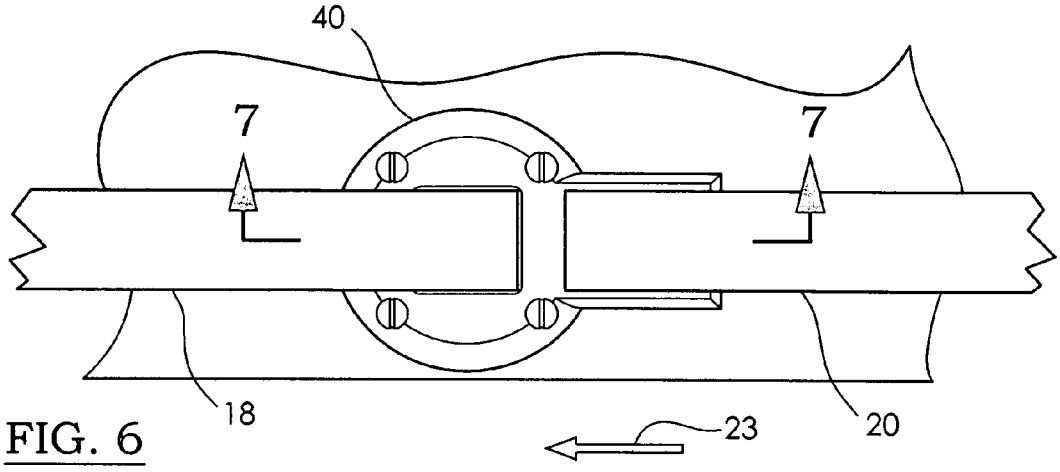
FIG. 6 is a top view of the pontoon boat deck and side of FIG. 3.
Figure 7A:
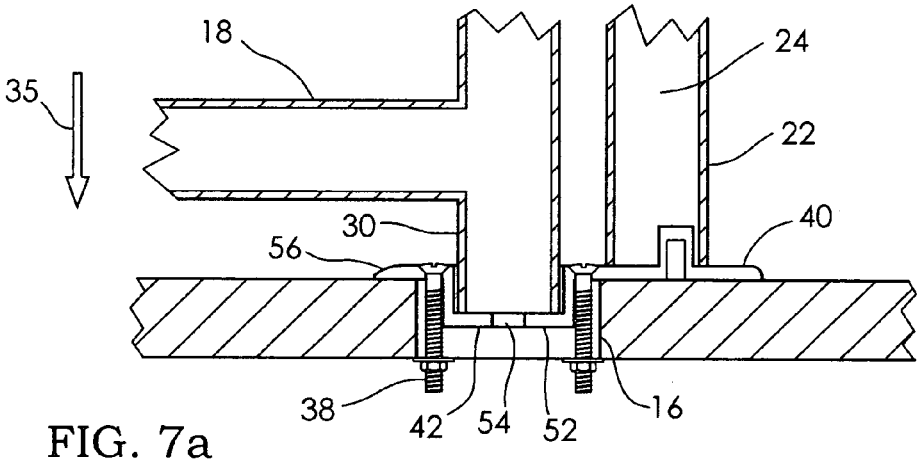
FIG. 7*a* is a side elevational sectional view of the pontoon boat of FIG. 3, taken along lines 7-7 of FIG. 6, and showing the lift gate latch in the down and latched position, and the jamb adjusted toward the gate.

Referring now to FIGS. 1, 2, 6, 7*a,* and 7*b,* the lift gate latch 40 comprises a cup 42 having a rectangular wall 44 extending between opposite upper 46 and lower 48 ends. The cup 42 has a hollow interior 50. The cup upper end 46 is open, and a floor 52 encloses the lower end 48. The floor 52 has a drain hole 54 through it. The cup 42 is adapted for insertion in the receiving hole 16. The cup interior 50 is adapted for receiving the stile 30, as depicted in FIG. 7*a* with the stile 30 inserted in the cup 42, and in FIG. 7*b* with the stile 30 raised upward to unlatch the gate 18.

Figure 7B:
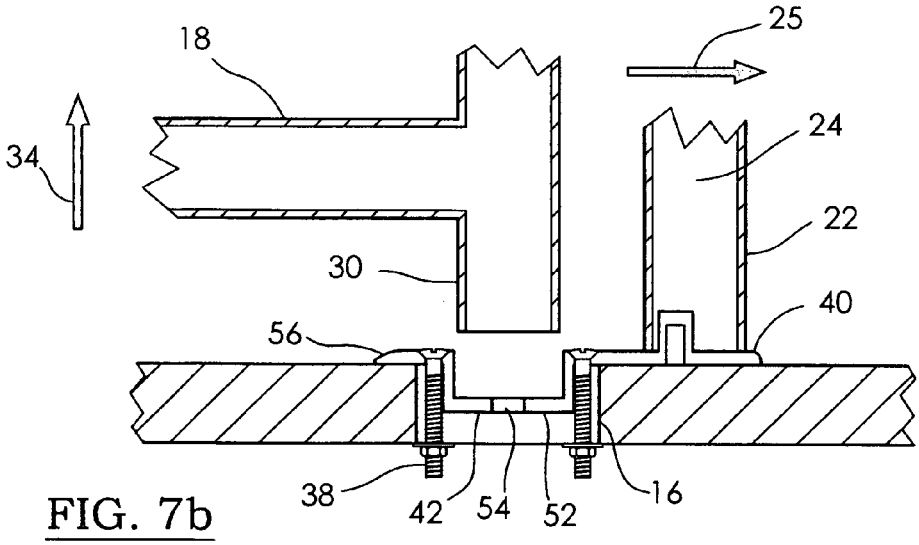
FIG. 7*b* is a side elevational sectional view of the pontoon boat of FIG. 3, taken along lines 7-7 of FIG. 6, and showing the lift gate latch in the up and unlatched position, and the jamb adjusted away from the gate.

A flange 56 encircles the cup upper end 46 and extends outward therefrom. The flange 56 has an upper surface 58 and a lower surface 60. The flange lower surface 60 is adapted for mounting against the boat deck 14. The flange 56 has a plurality of mounting holes 62, specifically four countersunk mounting holes, through it. Fasteners 38, such as bolts and nuts, attach the lift gate latch 40 to the boat deck 14, as illustrated in FIGS. 7*a* and 7*b*. A tongue 64 extends outward from the flange 56. The tongue 64 has an upper surface 66 and a lower surface 68. The tongue lower surface 68 is aligned with the flange lower surface 60 for placement against the boat deck 14. The flange 56 and the tongue 64 each have a predetermined height from the lower surface to the upper surface no greater than approximately one half inch (12 mm), and preferably closer to three sixteenths of an inch (5 mm). The flange 56 and the tongue 64 together present a low profile on the deck, and thereby will not trip personnel passing through the gate 18 or walking by near the handrail 20. This is an important safety consideration, and will help to earn a Coast Guard safety certification.

A block 70 extends upward from the tongue upper surface 66. The block 70 is adapted to be slidingly received in the jamb interior 24. The block 70 has a block width is 72 commensurate with the jamb interior width 26, and a block breadth 74 substantially less than the jamb interior breadth 28. This is to allow adjustment of the jamb 22 during installation, thereby adjusting clearance between the jamb 22 and the stile 30. This novel feature is shown in FIG. 7*a* with the jamb 22 adjusted toward the gate 18 as shown by arrow 23, and in FIG. 7*b* with the jamb 22 adjusted away from the gate 18 as shown by arrow 25. After installation and adjustment, the jamb 22 and block 70 can be drilled transversely, and fasteners (not shown) installed to secure the jamb 22 to the block 70.

Turning now to FIGS. 3, 4, and 5, as well as FIGS. 6, 7*a,* and 7*b,* the operation of the invention reveals that upon opening the lift gate 18, the lift gate will rise as shown by arrow 34 in FIGS. 4 and 7*b,* the stile 30 will pass above the cup wall upper end 46, and the gate 18 will be pivoted open as shown by arrow 36 in FIG. 5. Upon closing the lift gate, the gate 18 will be pivoted closed, and the stile 30 will pass above the cup wall upper end 46. The lift gate 18 will then be lowered as shown by arrow 35 in FIG. 7*a,* such that the stile 30 will be received in the cup 42, thereby latching the gate.

The lift gate latch is typically molded from a polymeric material, which can be either a thermoplastic resin or a thermoset resin. Alternatively, other materials, such as metals, can be used.

Figure 8:
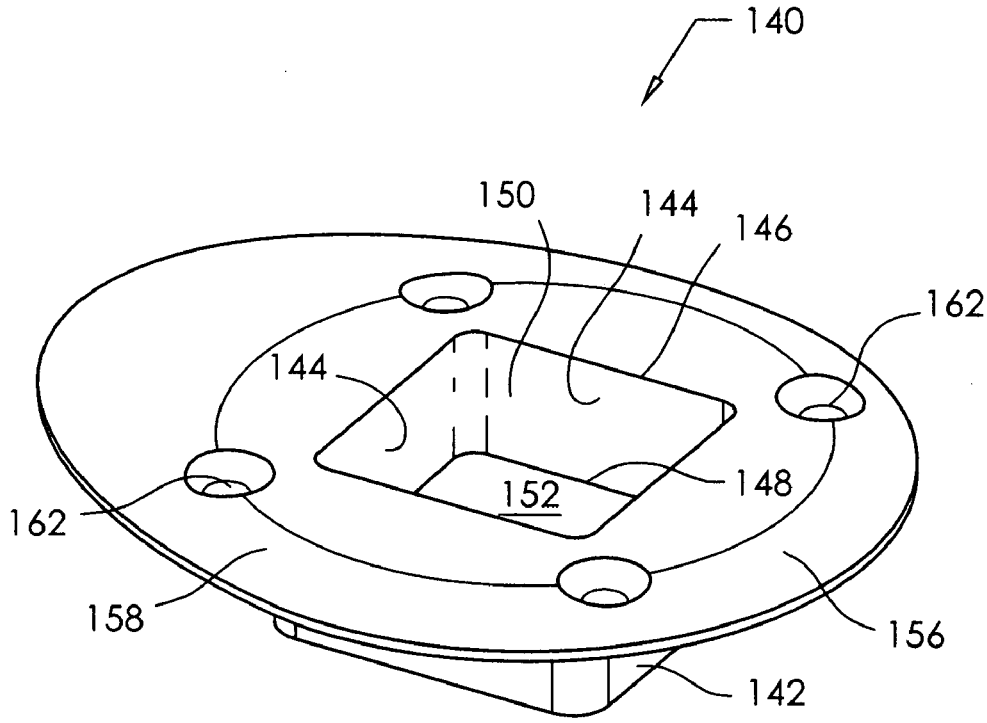
FIG. 8 is a perspective view of another embodiment of the lift gate latch constructed in accordance with the invention.
Figure 9:
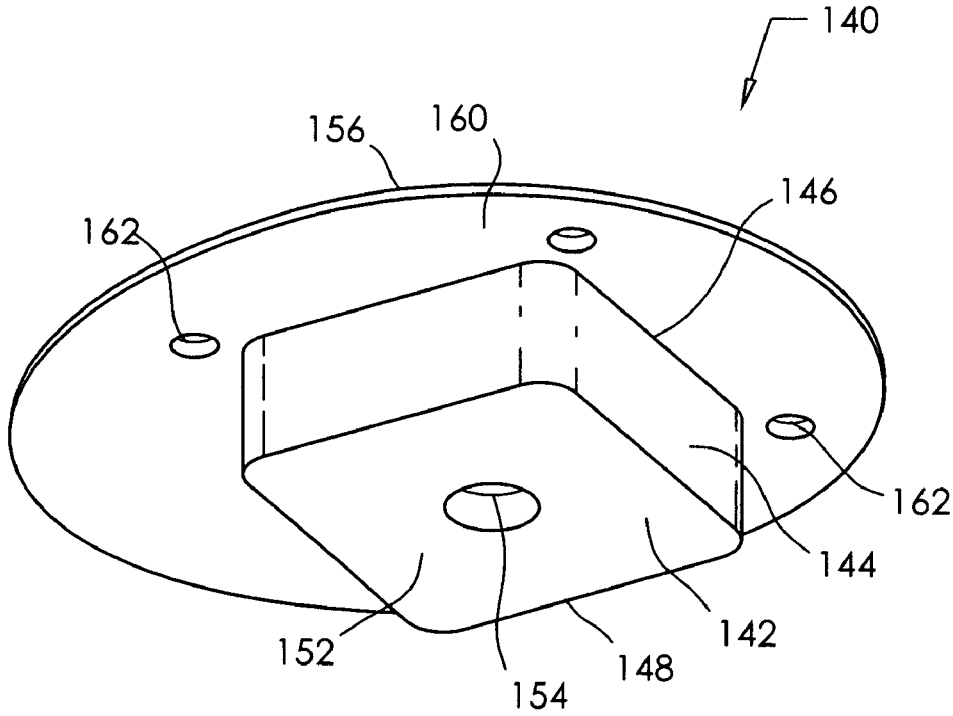
FIG. 9 is another perspective view of the lift gate latch of FIG. 8.

Referring now to FIGS. 8, and 9, another embodiment of the lift gate latch is shown at 140. Lift gate latch 140 is similar to lift gate latch 40 described above, in that it is for use in connection with a lift gate 18 and a handrail 20 on a boat 10. Lift gate latch 140 comprises a cup 142 having a rectangular wall 144 extending between opposite upper 146 and lower 148 ends. The cup 142 has a hollow interior 150. The cup upper end 146 is open, and a floor 152 encloses the lower end 148. The floor 152 has a drain hole 154 through it. The cup 142 is adapted for insertion in the receiving hole 16. The cup interior 150 is adapted for receiving the stile 30.

A flange 156 encircles the cup upper end 146 and extends outward therefrom. The flange 156 has an upper surface 158 and a lower surface 160. The flange lower surface 160 is adapted for mounting against the boat deck 14. The flange 156 has a plurality of mounting holes 162, specifically four countersunk mounting holes, through it.

Lift gate latch 140 differs from lift gate latch 40 described above, in that it includes no tongue 64, and no block 70. The jamb 22 is mounted independently of the lift gate latch 140. The operation of the lift gate 18 in cooperation with the lift gate latch 140 is the same as that of lift gate latch 40.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST

Recessed Lift Gate Latch

| PART NO. | DESCRIPTION |
|---|---|
| 10 | boat |
| 12 | gunwale |
| 14 | deck |
| 16 | receiving hole |
| 18 | lift gate |
| 20 | handrail |
| 22 | jamb |
| 23 | toward gate arrow |
| 24 | jamb interior |
| 25 | away from gate arrow |
| 26 | predetermined width |
| 28 | predetermined breadth |
| 30 | stile |
| 32 | hinge |
| 34 | upward arrow |
| 35 | downward arrow |
| 36 | pivot arrow |
| 38 | fasteners |
| 40 | lift gate latch |
| 42 | cup |
| 44 | wall |
| 46 | upper end |
| 48 | lower end |
| 50 | cup interior |
| 52 | floor |
| 54 | drain hole |

-continued

| PART NO. | DESCRIPTION |
|---|---|
| 56 | flange |
| 58 | flange upper surface |
| 60 | flange lower surface |
| 62 | mounting holes |
| 64 | tongue |
| 66 | tongue upper surface |
| 68 | tongue lower surface |
| 70 | block |
| 72 | block width |
| 74 | block breadth |
| 140 | lift gate latch |
| 142 | cup |
| 144 | wall |
| 146 | upper end |
| 148 | lower end |
| 150 | cup interior |
| 152 | floor |
| 154 | drain hole |
| 156 | flange |
| 158 | flange upper surface |
| 160 | flange lower surface |
| 162 | mounting holes |

The invention claimed is:

1. A lift gate latch used in connection with a lift gate and a handrail on a boat, the boat having a gunwale and a deck, the deck having a receiving hole adjacent the gunwale, the handrail having a jamb, the jamb having a hollow interior, the jamb interior having a predetermined width transverse to the boat, and a predetermined breadth longitudinal to the boat, the lift gate having at least one stile, the lift gate having a hinge, the lift gate being able to rise upwardly on the hinge, the lift gate being able to pivot on the hinge between a closed and an open position, the lift gate latch comprising:

a cup having a wall extending between opposite upper and lower ends, the cup having a hollow interior, the upper end being open, the cup having a floor enclosing the lower end, the cup being adapted for insertion in the receiving hole, the cup interior being adapted for receiving the stile;

a flange encircling the cup upper end and extending outward therefrom, the flange having an upper surface and a lower surface, the flange lower surface being adapted for mounting against the boat deck, the flange having a predetermined height from the lower surface to the upper surface;

a tongue extending outward from the flange, the tongue having an upper surface and a lower surface, the tongue lower surface being aligned with the flange lower surface for placement against the boat deck, the tongue having a predetermined height from the lower surface to the upper surface; and a block extending upward from the tongue upper surface, the block being adapted to be slidingly received in the jamb interior, the block having a width commensurate with the jamb interior width, the block having a breadth substantially less than the jamb interior breadth, so as to allow adjustment of the jamb during installation, thereby adjusting clearance between the jamb and the stile; so that upon opening the lift gate, the lift gate will rise, the stile will pass above the upper end and the gate will be pivoted open, and upon closing the lift gate, the gate will be pivoted closed, the stile will pass above the upper end, and the lift gate will be lowered such that the stile will be received in the cup, thereby latching the gate.

2. The lift gate latch of claim 1, wherein the lift gate latch is molded from a polymeric material selected from the group consisting of thermoplastic resins and thermoset resins.

3. The lift gate latch of claim 1, wherein:

the flange has at least one mounting hole therethrough; and the floor has a drain hole therethrough.

4. The lift gate latch of claim 1, wherein:

the cup wall is rectangular; and the stile is rectangular in cross-section for sliding engagement with the cup interior.

5. The lift gate latch of claim 1, wherein the tongue predetermined height and the flange predetermined height each are no greater than approximately one half inch (12 mm), so as to preclude being a trip hazard.

6. A lift gate latch used in connection with a lift gate and a handrail on a boat, the boat having a gunwale and a deck, the deck having a receiving hole adjacent the gunwale, the handrail having a jamb, the jamb having a hollow interior, the jamb interior having a predetermined width transverse to the boat, and a predetermined breadth longitudinal to the boat, the lift gate having at least one stile, the stile and jamb being rectangular in cross-section, the lift gate having a hinge, the lift gate being able to rise upwardly on the hinge, the lift gate being able to pivot on the hinge between a closed and an open position, the lift gate latch comprising:

a cup having a rectangular wall extending between opposite upper and lower ends, the cup having a hollow interior, the upper end being open, the cup having a floor enclosing the lower end, the floor having a drain hole therethrough, the cup being adapted for insertion in the receiving hole, the cup interior being adapted for receiving the stile;

a flange encircling the cup upper end and extending outward therefrom, the flange having an upper surface and a lower surface, the flange lower surface being adapted for mounting against the boat deck, the flange having a predetermined height from the lower surface to the upper surface, the flange having a plurality of mounting holes therethrough;

a tongue extending outward from the flange, the tongue having an upper surface and lower surface, the tongue lower surface being aligned with the flange lower surface for placement against the boat deck, the tongue having a predetermined height from the lower surface to the upper surface; and a block extending upward from the tongue upper surface, the block being adapted to be slidingly received in the jamb interior, the block having a width commensurate with the jamb interior width, the block having a breadth substantially less than the jamb interior breadth, so as to allow adjustment of the jamb during installation, thereby adjusting clearance between the jamb and the stile; so that upon opening the lift gate, the lift gate will rise, the stile will pass above the upper end and the gate will be pivoted open, and upon closing the lift gate, the gate will be pivoted closed, the stile will pass above the upper end, and the lift gate will be lowered such that the stile will be received in the cup, thereby latching the gate.

7. The lift gate latch of claim 6, wherein the lift gate latch is molded from a polymeric material selected from the group consisting of thermoplastic resins and thermoset resins.

8. The lift gate latch of claim 6, wherein the tongue predetermined height and the flange predetermined height each are no greater than approximately one half inch (12 mm), so as to preclude being a trip hazard.

* * * * *